US007934333B1

(12) United States Patent
Tuz

(10) Patent No.: US 7,934,333 B1
(45) Date of Patent: May 3, 2011

(54) PISTOL CONCEALMENT DEVICE

(76) Inventor: Michael Tuz, Sylmar, CA (US)

( * ) Notice: Subject to any disclaimer, the term of this patent is extended or adjusted under 35 U.S.C. 154(b) by 624 days.

(21) Appl. No.: 11/863,194

(22) Filed: Sep. 27, 2007

Related U.S. Application Data

(62) Division of application No. 10/850,514, filed on May 21, 2004, now abandoned.

(51) Int. Cl.
*F41A 29/00* (2006.01)

(52) U.S. Cl. ..... 42/96

(58) Field of Classification Search ..... 42/96, 70.07
See application file for complete search history.

(56) References Cited

U.S. PATENT DOCUMENTS

| | | | |
|---|---|---|---|
| 309,292 | A | 12/1884 | Browne |
| 468,556 | A | 2/1892 | Anderson |
| 1,023,741 | A | 4/1912 | Kreith |
| 1,191,339 | A | 7/1916 | Noye |
| 2,132,323 | A | 10/1938 | Sanders |
| 3,354,570 | A | 11/1967 | Rizzo, Jr. |
| 3,707,250 | A | 12/1972 | Esposito |
| 3,720,013 | A | 3/1973 | McDonald |
| 4,235,356 | A | 11/1980 | Atchisson |
| 4,387,523 | A | 6/1983 | Gallagher |
| 4,414,610 | A | 11/1983 | Gale et al. |
| 4,466,537 | A | 8/1984 | McMahan |
| 4,689,908 | A | 9/1987 | McClellan |
| 4,741,465 | A | 5/1988 | Johnson |
| 4,836,425 | A | 6/1989 | McClellan |
| 5,581,898 | A | 12/1996 | Thummel |
| 5,590,486 | A | 1/1997 | Moore |
| 5,720,193 | A | 2/1998 | Dick |
| 5,881,938 | A | 3/1999 | Wakefield |
| 5,918,784 | A | 7/1999 | Serpa |
| 5,924,233 | A | 7/1999 | Strobel |
| 6,154,995 | A | 12/2000 | Lenoir et al. |
| 6,253,915 | B1 | 7/2001 | Mesica et al. |
| 7,117,625 | B2 | 10/2006 | Pikielny |
| 2002/0011504 | A1 | 1/2002 | Cerato |

*Primary Examiner* — Michelle (Shelley) Clement
(74) *Attorney, Agent, or Firm* — Kenneth L. Green

(57) ABSTRACT

A pistol is concealed and stabilized by filling in an area below the barrel and in front of the grip with a spacer. The result is a rectangular shape similar to a wallet, which shape conceals the presence of the pistol when carried in a pocket (i.e., de-prints the pistol shape), and stabilizes the pistol in the pocket. The spacer may be attached to a trigger guard, to a portion of the pistol frame beneath the forward end of the barrel, or be integrated with the pistol grips, creating the rectangular shape. The spacer may further include a laser aiming device. In one embodiment, the spacer securely grasps a curved portion of the trigger guard and includes a contoured rear surface which is urged against a lower leading edge of the grip, thus firmly establishing a position for the device relative to the pistol.

20 Claims, 6 Drawing Sheets

PISTOL CONCEALMENT DEVICE

The present application is a Divisional of U.S. patent application Ser. No. 10/850,514 filed May 21, 2004 which claims the benefit of U.S. Provisional Application Ser. No. 60/546,694, filed Feb. 20, 2004, which applications are incorporated herein in their entirely by reference.

BACKGROUND OF THE INVENTION

The present invention relates to concealment of pocket pistols, and in particular to altering the profile of a pocket pistol to both alter the outline of a pistol carried in a pocket, and to stabilize the attitude of the pistol in the pocket.

Off duty and plain clothes law enforcement officers generally carry concealed weapons, and are in some instances required to carry such weapons. When an officer carries a pocket pistol, the outline of the piston may be observable, and either alert a criminal, or create concern among bystanders. Various articles have been developed to address these issues, but none have provided an adequate solution.

U.S. Pat. No. 4,387,523 for "Wallet Holster for a Semi Automatic Weapon," describes a wallet shaped holster for providing concealment. Although the wallet holster alters the outline of the pistol, the feel of the grips is lost, and access to the safety, magazine, magazine release, etc. may be reduced.

U.S. Pat. No. 4,466,537 for "Concealable Holster," describes a holster similar to the holster of the '523 patent, but is larger and somewhat cumbersome, in addition to having the same disadvantages as the '523 patent.

U.S. Pat. No. 4,741,465 for "Concealment Pocket Holster," and U.S. Pat. No. 3,720,013 for "Handgun Concealing Pouch," describe pouches for carrying revolvers, which pouches alter the profile to provide concealment. Such pouches further restrict access to safeties, magazines, magazine releases, etc., and are not suitable for pistols.

Further, pocket pistols are not well suited for aiming with standard sights. An ideal solution is the addition of a laser site such as taught in U.S. Pat. No. 5,581,898 for "Modular Sighting Laser for a Firearm." Unfortunately, the laser sight described in the '898 patent does not substantially alter the profile of a pistol carried in a pocket, and it interferes with the use of another device used to provide concealment.

BRIEF SUMMARY OF THE INVENTION

The present invention addresses the above and other needs by providing a pistol which is concealed and stabilized by filling in an area below the barrel and in front of the grip with a spacer. The result is a rectangular shape similar to a wallet, which shape conceals the presence of the pistol when carried in a pocket (i.e., de-prints the pistol shape), and stabilizes the pistol in the pocket. The spacer according to the present invention may be attached to a trigger guard, to a portion of the pistol frame beneath the forward end of the barrel, or be integrated with the pistol grips, creating the rectangular shape. The spacer may further include a laser aiming device. In one embodiment, the spacer securely grasps a curved portion of the trigger guard and includes a contoured rear surface which is urged against a lower leading edge of the grip, thus firmly establishing a position for the spacer relative to the pistol.

In accordance with one aspect of the invention, there is provided a pistol concealment device for a pistol having a barrel assembly, a hand grip, and a trigger guard. The pistol has a first distance extending horizontally from a front of the hand grip to a forward end of the barrel assembly, and a second distance extending vertically from an underside of the barrel assembly to a bottom of the hand grip. The concealment device comprising a spacer and a means for attaching the spacer to the pistol. The spacer has a length approximately equal to the first distance, a height approximately equal to the second distance, and a recessed corner. The recessed corner is positioned around to the trigger to allow access for a trigger finger to pull the trigger. Attachment of the spacer to the pistol results in a substantially rectangular profile.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
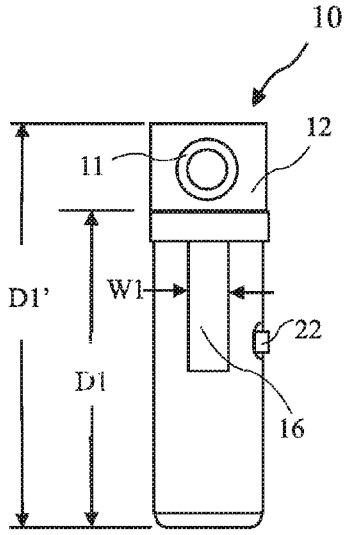
FIG. 1A (prior art)
FIG. 1A is front view of a prior art pistol.
Figure 1B:
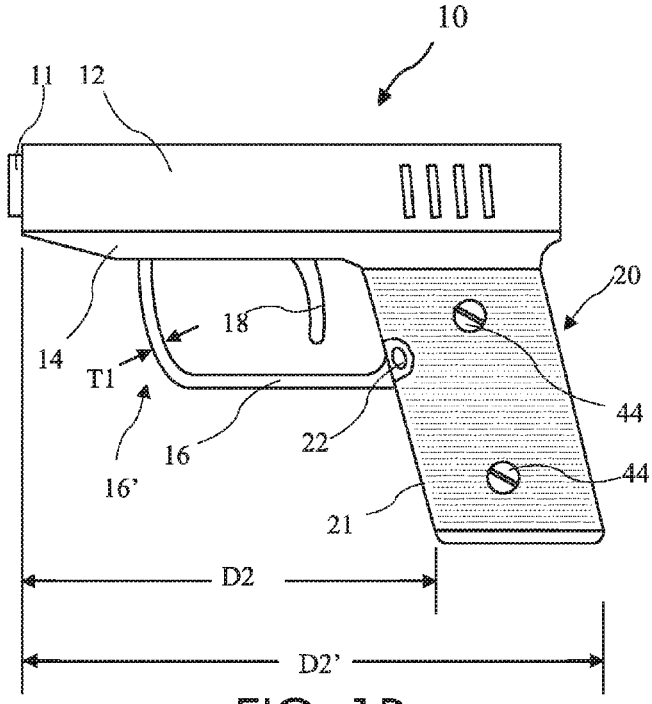
FIG. 1B (prior art)
FIG. 1B is a side view of the prior art pistol.
Figure 1C:
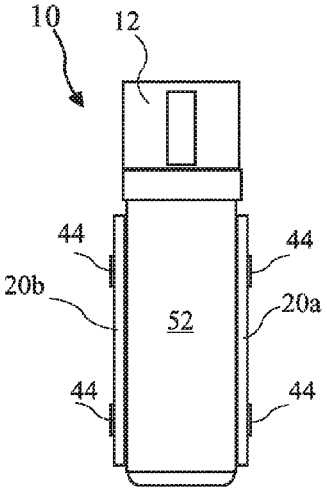
FIG. 1C (prior art)
FIG. 1C is a rear view of the prior art pistol.

A typical prior art pistol 10 is shown in FIG. 1A in front view, and in FIG. 1B is side view. The pistol 10 includes a frame 14, barrel assembly comprising a barrel 11 and a slide 12, a grip 20, a trigger guard 16, a trigger 18, and a magazine release 22. The pistol 10 has a horizontal distance D2 between the grip 20 and the front of the pistol, and a distance D2' which is the overall length of the pistol 10. The pistol 10 has a vertical distance D1 between the bottom of the barrel assembly and the bottom of grip portion 20, and a distance D1' which is the overall height of the pistol 10. The trigger guard has a width W1 and a thickness T1. The grip portion 20 has a grip front surface 21. A rear view of the pistol 10 is shown in FIG. 1C. Grips 20*a* and 20*b* are attached to a grip frame 52 of the frame 14 by grip screws 44.

Figure 1D:
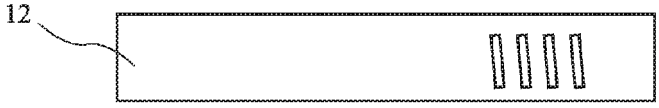
FIG. 1D (prior art)
FIG. 1D is a side view of a slide of the prior art pistol.
Figure 1E:
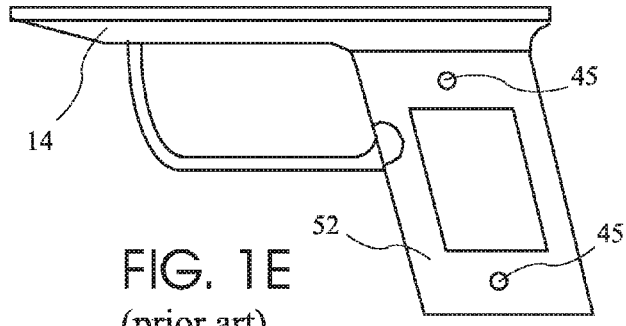
FIG. 1E (prior art)
FIG. 1E is a side view of a frame of the prior art pistol.

The slide 12 only is shown in side view in FIG. 1D, and the frame 14 only is shown in side view in FIG. 1E. The frame 14 includes the grip frame 52 having grip screw holes 45.

Figure 2A:
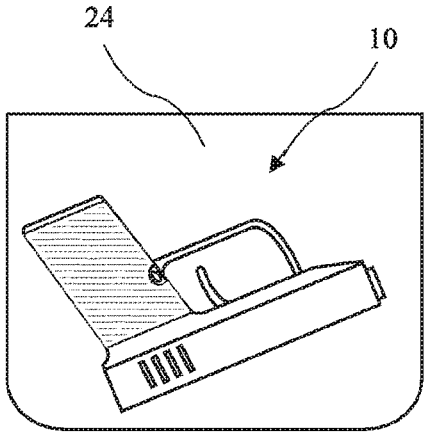
FIG. 2A (prior art)
FIG. 2A shows how the prior art pistol is likely to rest in a pocket.
Figure 2B:
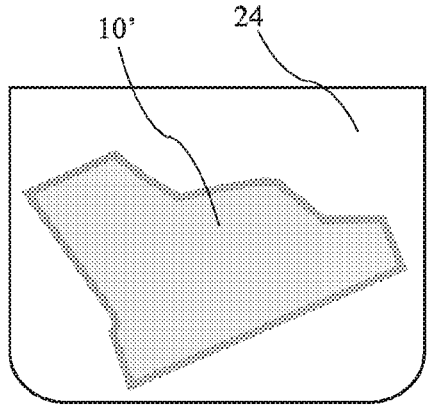
FIG. 2B (prior art)
FIG. 2B shows how the outline of the prior art pistols appears on the outside of the pocket.

Law enforcement officers often carry prior art small pistols (sometimes called pocket pistols) similar to the pistol 10 when off duty, or when in plain clothes. The some cases, it is convenient to carry the pistol 10 in a pocket 24 as shown in FIG. 2A. Unfortunately, the pistol 10 may rest in the position shown in FIG. 2A. making quick access to the pistol 10 difficult. Further, a clear outline 10' may be readily apparent as shown in FIG. 2B, which may cause alarm among those who are unaware that the carrier is a law enforcement officer, or may disclose the presence of the pistol to a criminal.

Figure 3C:
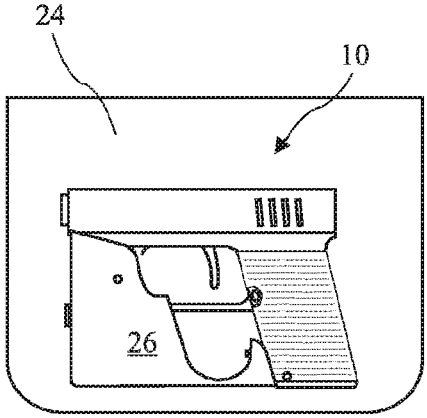
FIG. 3C shows how the pistol including the spacer is likely to rest in a pocket.
Figure 3D:
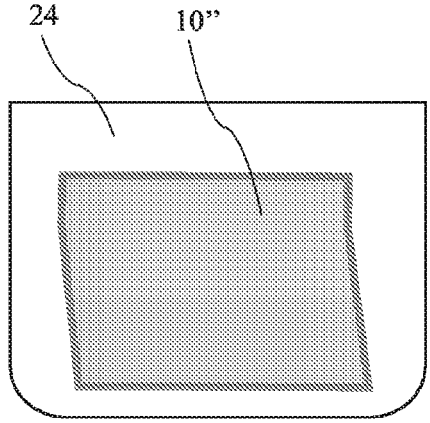
FIG. 3D shows how the pistol including the spacer appears on the outside of the pocket.
Figure 3A:
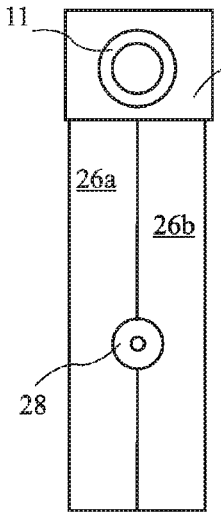
FIG. 3A is front view of a pistol including a spacer according to the present invention.
Figure 3B:
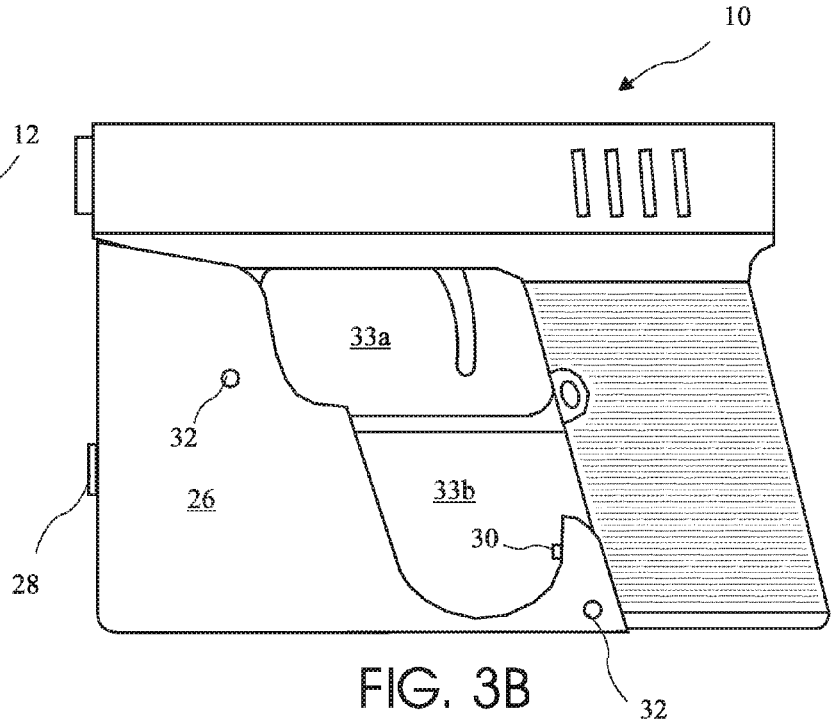
FIG. 3B is side view of the pistol including the spacer according to the present invention.

A pistol 10 with a spacer 26 according to the present invention is shown in FIG. 3A in front view, and in FIG. 3B in side view. The spacer 26 preferably is constructed of two sides 26*a* and 26*b*. A laser aiming device 28 may be included in the spacer 26, and an actuator (or switch) 30 (preferably an electrical switch) is included in the spacer 26 for controlling the laser aiming device 28. The spacer 26 may be assembled using at least one screw 32, and preferably two screws 32. The screws 32 preferable engage nuts held in shaped recesses in the opposite side of the device 26.

The spacer 26 fills in the area under the barrel assembly and in front of the grip to create a substantially rectangular outline, that is, there are some small variations due to, for example, the shape of the rear of the pistol 10, but the overall shape is rectangular. The spacer 26 and the pistol 10 combination defines a trigger opening 33*a* overlapping the interior of the trigger guard 16, allowing a trigger finger to access to the trigger 18, and a second opening 33*b* below the trigger guard 16 allowing at least one finger to grasp the grip portion 20.

The pistol 10 with the spacer 26 attached is shown in the pocket 24 in FIG. 3C. Because of the rectangular shape, the pistol 10 with spacer 26 remains in a predictable upright position, and is easily drawn from the pocket 24 if needed. An outline 10" of the pistol 10 with the spacer 26 attached in shown in FIG. 3D, which outline 10" resembles a wallet.

Figure 4A:
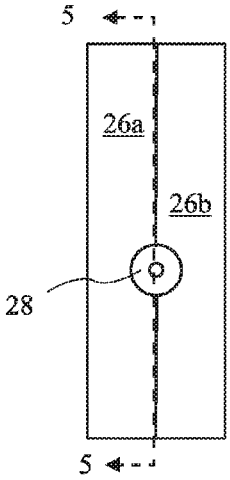
FIG. 4A is a front view of the spacer.
Figure 4B:
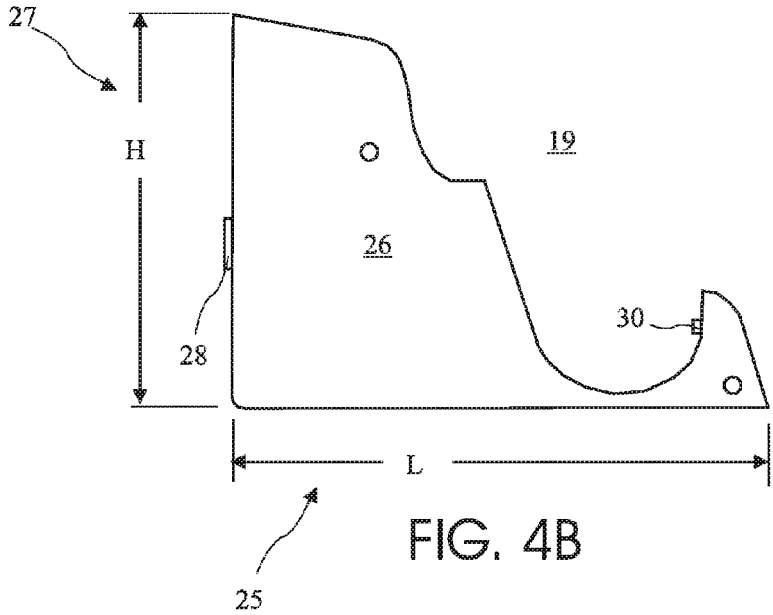
FIG. 4B is a side view of the spacer.

A front view of the spacer 26 is shown in FIG. 4A, and a side view of the spacer 26 is shown in FIG. 4B. The spacer 26 has a height H and a length L. The height H is approximately equal to the distance D1 and the length L is substantially equal to the distance D2 (see FIGS. 1A and 1B). A recessed corner is shown generally at 19. The recessed corner 19 is positioned and of sufficient size to provide access for a trigger finger to the trigger 18 when the spacer 26 is attached to the pistol 10.

Figure 4C:
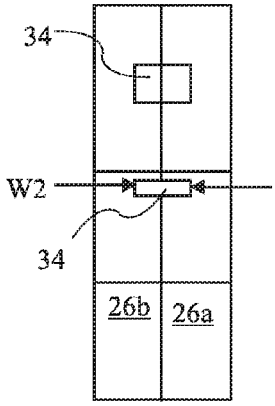
FIG. 4C is a rear view of the spacer.
Figure 4D:
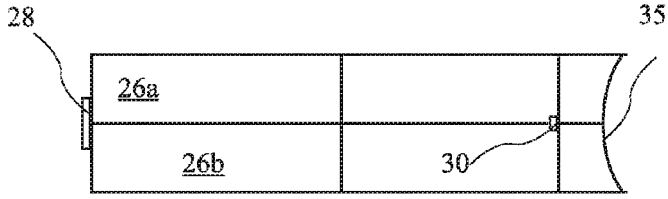
FIG. 4D is a top view of the spacer.

A rear view of the spacer 26 is shown in FIG. 4C, and a top view of the spacer 26 is shown in FIG. 4D. A trigger guard slot 34 is provided in the spacer 26 to allow the spacer to enclose a portion of the trigger guard 16 (see FIG. 1B), thereby attaching the spacer 26 to the pistol 10. The trigger guard slot 34 has a width W2 sized to provide a firm fit to the trigger guard 16 width W1 (see FIG. 1A). A contoured surface 35 cooperates with the grip front surface 21 (see FIG. 1B) to position the spacer 26 on the pistol 10, wherein assembling the spacer 16 over the trigger guard 16 causes the contoured surface 35 to be urged against the grip front surface 21. The spacer has a face 27 and a base 25.

Figure 5:
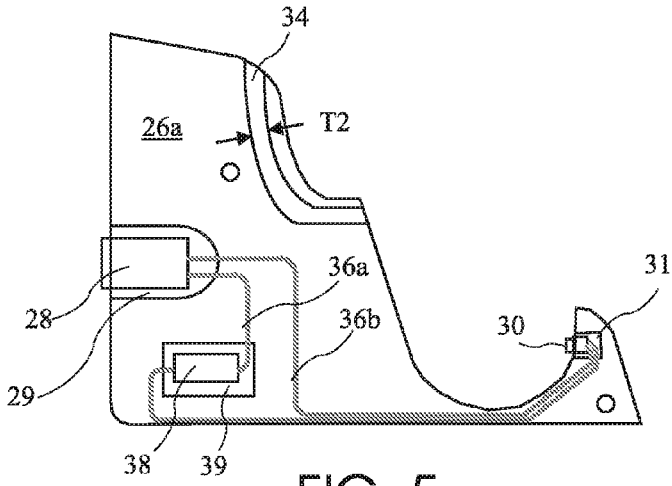
FIG. 5 is a cross-sectional view of the spacer taken along line 5-5 of FIG. 4A.

A cross-sectional view of the spacer 26 taken along line 5-5 of FIG. 4A is shown in FIG. 5. The trigger guard slot 34 is shown to curve down and to the rear substantially matching a curved portion of the trigger guard 16. The trigger guard slot 34 has a thickness T2 sufficient to allow the spacer 16 to be assembled over the trigger guard 16. A laser cavity 29 is provided for positioning the laser aiming device 28 in the spacer 26. A battery cavity 39 is provided for a battery 38 for powering the laser aiming device 28. A switch cavity 31 is provided for a switch 30 for turning the laser aiming device 28 on. The switch cavity 31 is located in a portion of the spacer 26 proximal to the grip 20 (see FIG. 1B) and on a rear surface of the second opening 33*b* (see FIG. 3B). Wires 36*a* and 36*b* electrically connect the laser aiming device 28 to the battery 38, through the switch 30. The wires 36*a*, 36*b* are preferably thin flat wires, and are preferably bonded to an interior surface of one of the sides 26*a*, 26*b*.

Figure 6A:
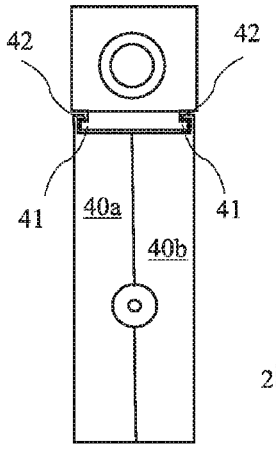
FIG. 6A is a front view of the pistol with a second embodiment of the spacer.
Figure 6B:
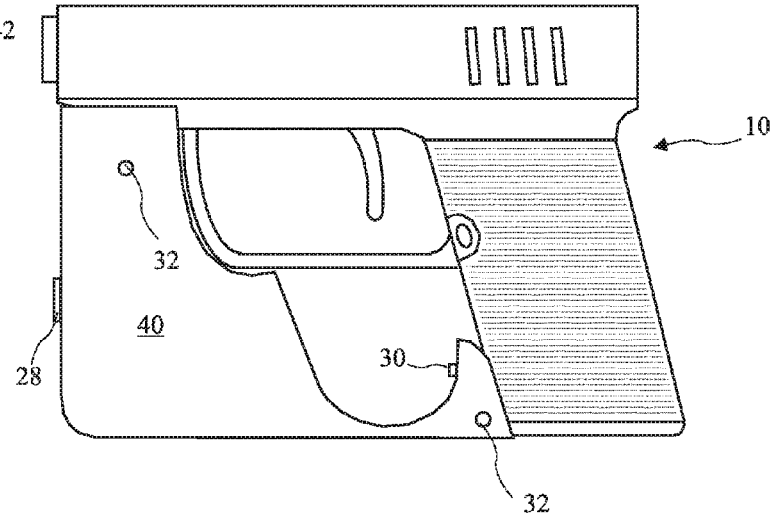
FIG. 6B is a side view of the pistol with the second embodiment of the spacer.

Another embodiment of the present invention including horizontal frame rails 41 in front of and above the trigger guard, cooperating with corresponding spacer rails 42 to attach a second spacer 40 to the pistol 10, is shown in front view in FIG. 6A and in side view in FIG. 6B. One of the screws 32 may be located near the rails 42, thereby applying gripping force to the cooperation of the rails 41, 42.

Figure 7A:
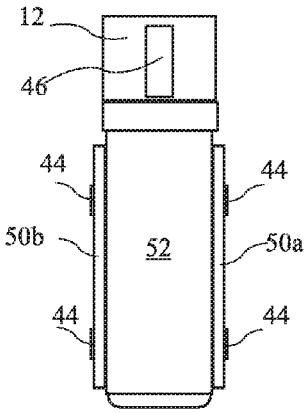
FIG. 7A is a rear view of the pistol with a third embodiment of the spacer.
Figure 7B:
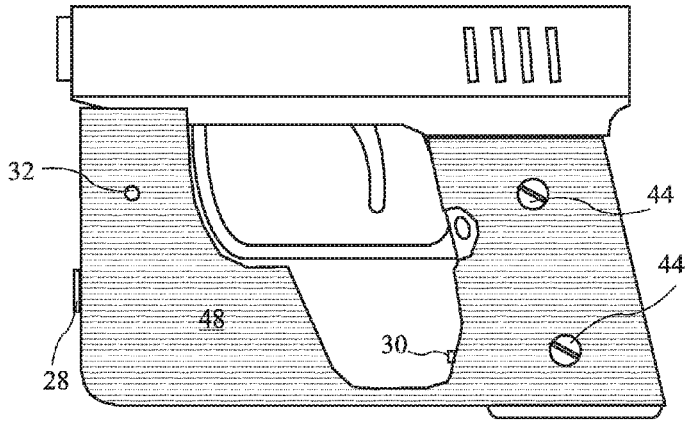
FIG. 7B is a side view of the pistol with the third embodiment of the spacer.

Yet another embodiment of the present invention including a spacer 48 having integral grips 50*a* and 50*b* is shown in FIG. 7A, wherein the spacer 48 is preferably attached to the frame using the grip screw holes 45 (see FIG. 1E).

Figure 8:
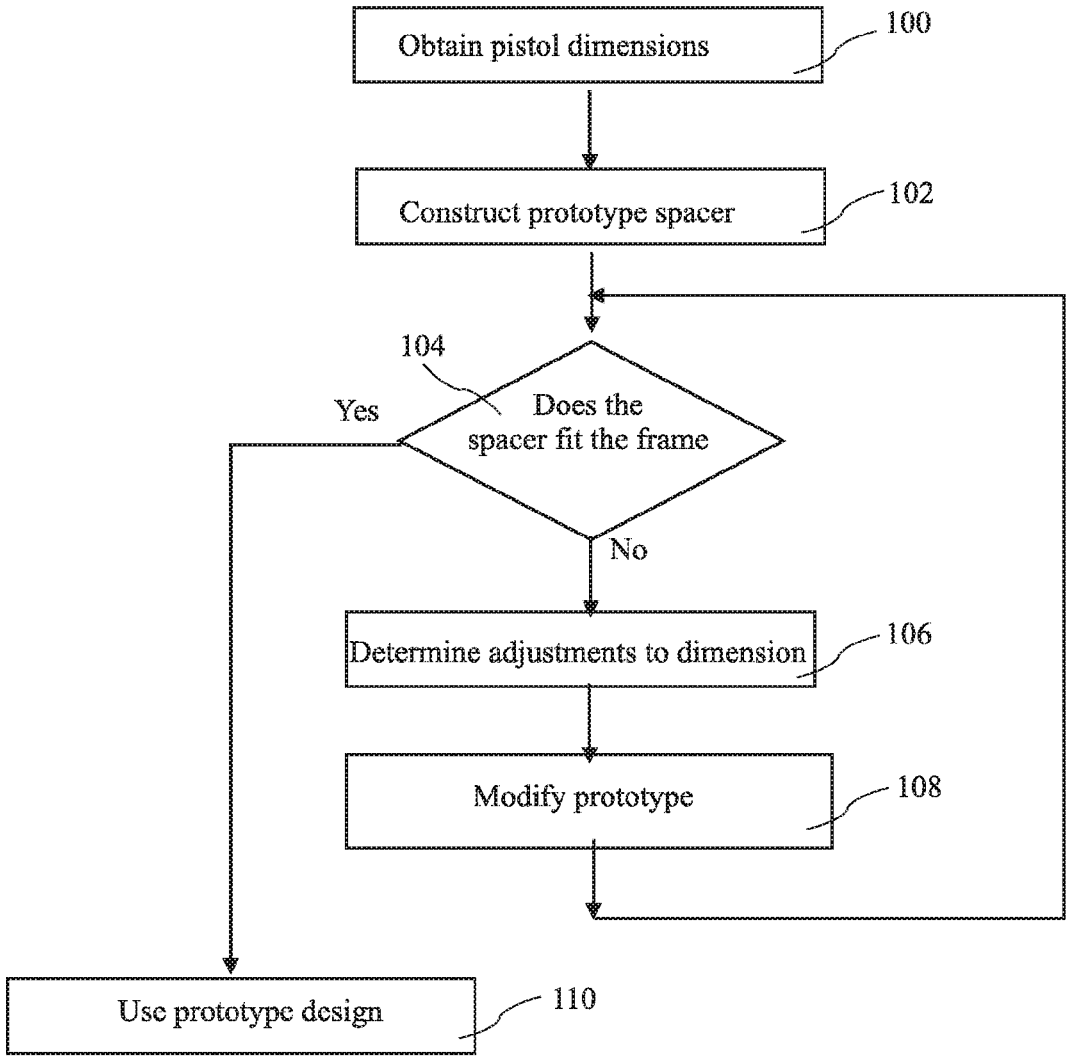
FIG. 8 describes a method of manufacturing the spacer.

A method for manufacturing a spacer 26 is described in FIG. 8. A starting set of pistol dimensions are obtained at step 100. A prototype of the spacer is made based on the starting set of pistol dimensions at step 102. The prototype device is compared to the pistol at step 104. If the prototype spacer is not a good fit to the pistol, the dimensions are adjusted if necessary at step 106. The prototype is modified, or a new prototype is made, based on the adjusted dimensions at step 108, and the comparison is repeated at 104. If the prototype spacer is a good fit to the pistol, the prototype dimensions are used to manufacture the spacers 26 at step 110.

In a preferred method, the comparison step 104 includes testing the aim of the laser aiming device 28, and adjusting the dimensions to adjust the aim of the laser aiming device 28. The laser cavity 28 (see FIG. 5) is preferably formed to sight-in the laser aiming device 28 such that at a distance of approximately 21 feet, a laser beam from the laser aiming device 28 will designate a bullet impact point. A preferred method also includes modifying the dimensions by modifying CNC machine code.

The method described in FIG. 8 is preferred for small to medium production levels. In the case of very high volume production, for example, when the space is included as part of a production pistol, other methods may be preferred, for example, injection molding.

The spacer 26 may be manufactured to mount to a variety of pistols, for example, the Baretta® Tomcat pistol, the Kel-Tec Inc. model P-32 and P-3AT pistols, the North American Arms® Inc. Guardian .380 pistol, the L. W. Seecamp Company Seecamp 32 pistol, the Rohrbaugh R-9 pistol, and many other pocket pistols. Various embodiments of the present invention are contemplated for these and other pistols, the various embodiments being adapted to individual pistol designs and/or dimensions, and any spacer providing a substantially rectangular profile when attached below the barrel assembly and in front of the grip, is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A concealable automatic pistol comprising:

an automatic pistol frame;

an automatic pistol barrel assembly attached to the frame and residing above the frame;

a grip frame portion of the automatic pistol frame below the automatic pistol barrel assembly and at the rear of the frame;

grips attached to the grip frame for grasping the pistol;

a trigger for firing the pistol, the trigger connected to the automatic pistol frame and residing under the automatic pistol barrel assembly and in front of the grip frame;

a trigger guard extending vertically downward from the automatic pistol frame in front of the trigger and horizontally below the trigger to the grip frame;

a first distance extending horizontally from a front of the grip frame to a forward end of the automatic pistol barrel assembly a second distance extending vertically from an underside of the automatic pistol barrel assembly to a bottom of the grips; and a spacer attached to the automatic pistol frame and having a fixed position residing entirely below the automatic pistol barrel assembly and ahead of the grip frame, the spacer having no attachment to any part of the automatic pistol barrel assembly and not interfering with movement of the automatic pistol barrel assembly during firing, and having:

a length approximately equal to the first distance;

a height approximately equal to the second distance; and a recessed corner allowing access to the trigger at all times and allowing at least one finger to grasp the grips.

2. The device of claim 1, wherein the spacer includes a contoured rear most surface which is urged against a lower leading edge of the grip frame, thus firmly establishing a position for the spacer relative to the pistol and providing a rectangular profile for concealment.

3. The device of claim 1, wherein the spacer includes a curved trigger guard slot shaped to engage with a forward curved portion of the trigger guard for attaching the spacer to the pistol and prevent movement of the spacer on the pistol, the trigger guard slot enclosing a forward surface and a rearward surface of the trigger guard thereby firmly attaching the spacer to the automatic pistol.

4. A concealable automatic pistol comprising:

an automatic pistol frame;

an automatic pistol barrel assembly including a barrel and a slide, the automatic pistol barrel assembly attached to the automatic pistol frame and residing above the frame;

a grip frame portion of the automatic pistol frame;

grips attached to the grip frame for grasping the pistol;

a trigger for firing the pistol, the trigger connected to the automatic pistol frame and residing under the automatic pistol barrel assembly and in front of the grip frame;

a trigger guard extending downward from the automatic pistol frame in front of the trigger and horizontally below the trigger to the grip frame; and a spacer fixedly attached to the automatic pistol frame and not in contact with the slide and not in contact with the barrel and not interfering with movement of the automatic pistol barrel assembly during firing, and filling in an area below the automatic pistol barrel assembly to a depth even with the bottom of the grips and in front of the grips forward to a front of the automatic pistol barrel assembly, the spacer including a trigger opening providing access for a trigger finger to the trigger at all times, wherein an outline of the pistol and spacer is rectangular other than a slope of the grip frame and irregularities in the rear and top of the pistol.

5. The automatic pistol of claim 4, wherein;

the spacer comprises two sides each including a trigger guard slot circling the trigger opening and curved similarly to a forward portion of the trigger guard; and the two sides of the spacer are attached to the automatic pistol frame by assembling the sides over the trigger guard, wherein the two sides of the trigger guard slot enclose both a forward surface and a rearward surface of the trigger guard and the forward portion of the trigger guard engages the trigger guard slot of the installed spacer thereby firmly attaching the spacer to the automatic pistol.

6. The automatic pistol of claim 5, wherein:

the trigger opening extends below the trigger guard; and the trigger opening allows access of a trigger finger to the trigger and allows at least one second finger to grasp the grips.

7. The automatic pistol of claim 5, wherein:

the trigger guard has a first width and a first thickness and the trigger guard slots have a second width and a second thickness; and the second width and the second thickness provide an interference fit to the first width and the first thickness when the spacer is assembled onto the pistol.

8. The automatic pistol of claim 5, wherein:

the spacer includes a contoured rear most surface; and when the spacer is attached to the frame, the contoured rear surface is urged against a grip front surface of the grip frame to firmly hold the spacer to the pistol frame.

9. A concealable automatic pistol comprising:

an automatic pistol frame;

an automatic pistol slide assembly including a slide and a barrel and attached to the automatic pistol frame by frame rails and residing above the automatic pistol frame;

a grip frame portion of the automatic pistol frame extending downward at the rear of the automatic pistol frame;

grips attached to the grip frame for grasping the pistol;

a trigger for firing the automatic pistol, the trigger connected to the automatic pistol frame and residing under the automatic pistol frame rails and in front of the grips;

a trigger guard extending in front of and below the trigger; and a spacer fixedly attached to the automatic pistol frame and not in contact with the automatic pistol slide assembly, and filling in an area below the frame rails and in front of the grip frame, the spacer having a horizontal base even with the bottom of the grip frame and a vertical face even with the front of the automatic pistol slide assembly forming a rectangular outline, and an opening in the spacer providing access for a trigger finger to the trigger, wherein the concealable automatic pistol has an outline having a rectangular shape other than a slope of the grip frame and irregularities in the rear and top of the automatic pistol.

10. The concealable automatic pistol of claim 9, wherein:

the spacer includes spacer rails aligned with the frame rails; and the spacer rails are pressed against the frame rails to attached the spacer to the frame.

11. The concealable automatic pistol of claim 9, wherein the spacer includes a curved trigger guard slot shaped to engage with a forward curved portion of the trigger guard to fixedly attach the spacer to the pistol.

12. The concealable automatic pistol of claim 11, wherein the spacer includes a contoured rear surface which is urged against a lower leading edge of the grip frame by the cooperation of the curved trigger guard slot with the trigger guard, thus firmly establishing a position for the spacer relative to the pistol.

13. The concealable automatic pistol of claim 9, wherein a rear edge of the base of the spacer is in contact with the grip frame.

14. The concealable automatic pistol of claim 9, wherein grips and the spacer are a single piece.

15. The pistol of claim 4, wherein the spacer includes a trigger opening and a second opening below the trigger opening, and wherein the trigger opening allows access of a trigger finger to the trigger, and the second opening allows at least one second finger to grasp the grip.

16. The pistol of claim 15 further including a laser aiming device, wherein a switch for actuating the laser aiming device resides in the second opening.

17. The concealable automatic pistol of claim 4, wherein:

the spacer includes a contoured rear surface matching a shape of a lower leading edge of the grip frame; and the contoured rear surface is urged against the lower leading edge of the grip frame by the cooperation of the trigger guard and a trigger guard slot in the space, thus firmly establishing a position for the spacer relative to the pistol.

18. The concealable automatic pistol of claim 9, wherein the spacer leaves the grips uncovered for allowing a comfortable grasp of the pistol and leaves a magazine release uncovered to allow unloading and reloading the pistol without removing the spacer.

19. The concealable automatic pistol of claim 18, wherein the spacer butts up against the grip frame.

20. The concealable automatic pistol of claim 9, wherein:

the spacer has flat vertical sides; and a base of the spacer comprises a flat horizontal surface reaching from a front lower corner of the spacer to a rear lower corner of the spacer and is approximately in the plane of a bottom surface of the grip frame and having approximately the same width as the spacer.

* * * * *